US006380892B1

(12) United States Patent
Choi et al.

(10) Patent No.: US 6,380,892 B1
(45) Date of Patent: Apr. 30, 2002

(54) ADAPTIVE BEAMFORMING METHOD IN AN IMT-2000 SYSTEM

(75) Inventors: Jin Ho Choi; Hee Gul Park, both of Kyonggi-do; Yoon Oh Yang, Seoul, all of (KR)

(73) Assignees: LG Information & Communications, Ltd.; LG Electronics Inc., both of Seoul (KR)

( * ) Notice: Subject to any disclaimer, the term of this patent is extended or adjusted under 35 U.S.C. 154(b) by 0 days.

(21) Appl. No.: 09/540,986

(22) Filed: Mar. 31, 2000

(30) Foreign Application Priority Data

Apr. 2, 1999 (KR) ..... 99 11664
Apr. 2, 1999 (KR) ..... 11665 99

(51) Int. Cl.[7] ..... H01Q 3/24
(52) U.S. Cl. ..... 342/372; 342/373
(58) Field of Search ..... 342/372, 373, 342/378, 375

(56) References Cited

U.S. PATENT DOCUMENTS 4,651,155 A * 3/1987 Baurle et al. ..... 342/378
4,771,289 A * 9/1988 Masak ..... 342/383
5,844,951 A * 12/1998 Proakis et al. ..... 375/347
5,952,965 A * 9/1999 Kowalski ..... 342/372
6,072,884 A * 6/2000 Kates ..... 381/318
6,154,552 A * 11/2000 Koroljow et al. ..... 381/313

* cited by examiner

*Primary Examiner*—Dao Phan
(74) *Attorney, Agent, or Firm*—Fleshner & Kim, LLP

(57) ABSTRACT

An adaptive beamforming apparatus and method of an array antenna in a communication system. First, a tentative symbol decision value is obtained by processing a traffic signal vector, and a final updated coefficient value is obtained by performing a least mean square (LMS) algorithm at least once with respect to the tentative symbol decision value and a pilot signal vector on the assumption that the tentative symbol decision value is a transmitted symbol value. Then an adaptive beam which corresponds to a final symbol decision value is formed using the traffic signal vector and the final updated coefficient value.

50 Claims, 3 Drawing Sheets p[n] : nth despreading signal vector r[n] : nth despreading traffic signal vector $\hat{s}_{(0)}[n]$ : tentative desicion variable $\hat{s}_{(1)}[n]$ : final decision variable

ADAPTIVE BEAMFORMING METHOD IN AN IMT-2000 SYSTEM

BACKGROUND OF THE INVENTION

1. Field of the Invention

The present invention relates to an adaptive beamforming method, and more particularly to an adaptive beamforming method of an indirect type array antenna in a communication system.

2. Background of the Related Art

Conventionally, a beamforming method of an array antenna in a direct sequence code division multiple access (DS-CDMA) system includes a method using only pilot channel information, or a blind algorithm method using only traffic channel information without the pilot channel information.

With respect to the method using only the pilot channel information, there exists a least mean square (hereinafter referred to as LMS) algorithm, and a recursive least square (hereinafter referred to as RLS) algorithm.

With respect to the blind algorithm method, which does not use reference signals (i.e., training signals) known to both a sending end and a receiving end, a constant modulus algorithm (CMA) method, and a 2-dimensional rake combiner method exist.

The principle of forming an adaptive beam of an array antenna according to the LMS algorithm will now be described.

The LMS algorithm is a kind of an adaptive algorithm using a data channel for transmitting actual user information and a channel for transmitting the reference signals (training signals) known to both the sending end and the receiving end.

Since the LMS algorithm uses the reference signals, filter coefficients can be stably updated. Also, since its evaluation function is convex, the convergence to a global minimum values is guaranteed. Also, the LMS algorithm can be implemented through a simple hardware structure, thus simplifying its circuit construction.

The LMS algorithm has been widely used in communication systems which can use the reference signals. The LMS algorithm as described above forms an adaptive beam of the array antenna using a dedicated physical data channel (DPDCH) and a dedicated physical control channel (DPCCH) in reverse dedicated channels.

The slot structures of the reverse channels in a related art system will be described with reference to the accompanying drawings.

FIG. 1 is a diagram illustrating the slot structures of the reverse DPDCH and the reverse DPCCH in the related art system.

Referring to FIG. 1, of the reverse channels, the dedicated channel is used to transfer the user information and the control information from a mobile station (not illustrated) to a base station (not illustrated).

The reverse dedicated channel includes the DPDCH 1 for transmitting user data, and the DPCCH 2 for transmitting pilot information, transmit power control information, and transport format indicator information.

The information per slot transmitted through the DPCCH 2 of the reverse dedicated channel in the system are the pilot information, the transmit power control (TPC) information, and the transport format indicator (TFI) information. The pilot information is used for channel estimation and adaptive beamforming. The TPC is used for open loop power control. The TFI is used for transmitting transport formats in the unit of 16 slots.

FIG. 2 is a block diagram illustrating the construction of the related beamforming apparatus of an array antenna.

Referring to FIG. 2, the signals received through respective antennas (ANT despread through a respective demodulation process through one of corresponding demodulating parts 10, 11, . . . 12, and down-sampling process through one of corresponding downlink sampling and despreading parts 20, 21, . . . 22. Thereafter, weighted values of a beamforming part 30 are updated every moment.

Here, it is assumed that K transmit signals and L antennas exist in the system, and the adaptive beam is formed after the despreading. Also, the adaptive beamforming prior to the despreading can be easily implemented by substituting spreading codes into an equation mentioned below.

If weight vectors of the beamforming part 30 with respect to a first transmitted signal are represented as $w_1=[w_{1,1}\ w_{2,1}\ \ldots\ w_{L,1}]^T$, the evaluation function $C_p(w_1[n])$ in the LMS algorithm is defined by the following equation (1).

$$C_p(w_1[n])=E[|\overline{A_1}\overline{s_1}[n]-w^H{}_1[n]\overline{P_1}[n]|^2] \quad \text{Eq. (1)}$$

Here, $\overline{A_1}$ is the size of the pilot channel signal of the first transmitted signal, $\overline{s_1}[n]$ is the n-th signal known to the receiving end in advance, and $\overline{P_1}$ is the pilot signal vector despreading through the channel, which is defined by the following equation (2).

$$\overline{P_1}[n]=[\overline{P_{1,1}}\,\overline{P_{2,1}}\ \ldots\ \overline{P_{L,1}}]^T \quad \text{Eq. (2)}$$

The LMS algorithm according to equations (1) and (2) can repeatedly obtain the optimum coefficient defined as $w_1[n]$ by the following equation (3) using the pilot signal known to the receiving end.

$$w_1[n]=w_1[n-1]+\mu_p\epsilon_{LMS}[n]\overline{p_1}[n] \quad \text{Eq. (3)}$$

Here, * denotes a conjugate complex number, and $\epsilon_{LMS}$ is defined by the following equation (4).

$$\epsilon_{LMS}=\overline{A_1}\overline{s_1}[n]-w_1{}^H[n-1]\overline{p_1}[n] \quad \text{Eq. (4)}$$

Since in the DPDCH 1, only the traffic signal, i.e., the data signal, exists, but the reference signal known to the receiving end in advance does not exist, tentative decision values are obtained using a decision dedicated (DD) algorithm. Here, LMS-DD means obtaining the tentative decision values and using the LMS algorithm.

The evaluation function of the LMS-DD is given by the following equation (5).

$$Cr(w_1[n])=E[|\overline{A_1}\overline{s_1}[n]\hat{s}_1[n]-w_1{}^H[n]\overline{r_1}[n]|^2] \quad \text{Eq. (5)}$$

Here, $A_1$ denotes the traffic signal size and $\hat{s}_1$ denotes the tentative decision value needed to use the LMS algorithm. This value can be represented by the following equation (6).

$$\hat{s}_1[n]=\text{dec}\{w_1{}^H[n]\overline{r_1}[n]\} \quad \text{Eq. (6)}$$

In equation (6), dec{} denotes a detection function. In order to guarantee the reliability of the tentative decision value, the coefficient updating is not performed with respect to the signal which is below the threshold value and has a severe fading effect (a case of a bypass mode).

Accordingly, the despreading signal vector $\overline{r_1}[n]$ which is received by the receiver and the value of which is not known in advance is defined by the following equation.

$$\overline{r_1}[n]=[\overline{r_{1,1}r_{2,1}} \ldots \overline{r_{L,1}}]^{\tau} \quad \text{Eq. (7)}$$

Also, the filter coefficient in the DD-LMS algorithm is updated according to the following equation (8).

$$w_1[n])=w_1[n-1]+\mu_1\epsilon'_{DD}[n]\overline{r_1}[n] \quad \text{Eq. (8)}$$

Here, $\epsilon_{DD}$ is defined by the following equation (9).

$$\epsilon_{DD}=A_1\bar{s}_1[n]\hat{S}_1[n]-w_1^H[n]\overline{r_1}[n] \quad \text{Eq. (9)}$$

As described above, since the DPCCH 2 of the reverse dedicated channels is not constructed to purely support the pilot channel, the TPC and the TFI parts, where the pilot information cannot be used, are not used for the adaptive beamforming. Specifically, the system as described above does not have any technique for implementing the above-described adaptive beamforming method.

The above references are incorporated by reference herein where appropriate for appropriate teachings of additional or alternative details, features and/or technical background.

SUMMARY OF THE INVENTION

An object of the present invention is to provide an adaptive beamforming apparatus and method of an array antenna in a communication system that substantially obviates one or more of the problems due to limitations and disadvantages of the related art.

Another object of the present invention is to provide an adaptive beamforming apparatus and method of an array antenna in a communication system which can increase the reverse system capacity of the system and wide-band CDMA next-generation mobile communication system.

Another object of the present invention is to provide an adaptive beamforming method of an array antenna in a communication system which can substantially remove an interference effect and thus maximize an antenna diversity effect.

To achieve at least the above objects in whole or in parts, there is provided an adaptive beamforming method that uses the combination of the Decision Dedicated Least Mean Square (DD-LMS) algorithm using the tentative symbol decision value of the traffic signal and the LMS algorithm using the pilot symbol when forming the adaptive beam of the array antenna with the despreading signal. In other words, the tentative symbol decision value is obtained by processing the traffic signal vector first. Thereafter, it is assumed that the tentative symbol decision value is the transmitted symbol value, and the final updated value of the coefficient is obtained by performing at least once the LMS algorithm with respect to the tentative symbol decision value and the pilot signal vector. Last, an adaptive beam corresponding to the final symbol decision value is formed using the traffic signal vector and the final updated value of the coefficient.

To further achieve the above-described objects of the present invention in a whole or in parts, there is provided an adaptive beamforming apparatus of an array antenna, including a first beamforming element, coupled to receive a first signal vector and to form a first adaptive beam, a detection function element, coupled to receive the first adaptive beam and to form a tentative symbol decision value, a first least mean square (LMS) element, coupled to receive at least one of a second signal vector, a known vector, and a feedback signal to generate a first updated coefficient value, a second LMS element, coupled to receive at least one of the first signal vector, the tentative symbol decision value, and the first updated coefficient value to form a second updated coefficient value, and a second beamforming element, coupled to receive the despreading traffic signal vector and the second updated coefficient value and to form a second adaptive beam.

To further achieve the above-described objects of the present invention in a whole or in parts, there is provided an adaptive beamforming apparatus of an array antenna, including a first beamforming element coupled to receive at least one of a first signal vector and a feedback signal to form a first adaptive beam, a decision element coupled to receive the first adaptive beam and output a tentative symbol decision value, a least mean square (LMS) element coupled to receive at least one of the first signal vector, the tentative symbol decision value, a known vector, a second signal vector, and the feedback signal to form an updated coefficient value, and a second beamforming element coupled to receive the first signal vector and the updated coefficient value to generate a final symbol decision value as an adaptive beam.

To further achieve the above-described objects of the present invention in a whole or in parts, there is provided an adaptive beamforming apparatus of an array antenna, including a first beamforming element coupled to receive at least one of a first signal vector and a first feedback value, to form a first adaptive beam, a first least mean square (LMS) element coupled to receive at least one of a second signal vector, a known vector, and a second feedback signal to generate a first updated coefficient value, a decision element coupled to receive the first adaptive beam and to form a tentative symbol decision value, a second LMS element, coupled to receive at least one of the first signal vector, the tentative symbol decision value, the known vector, the second signal vector and a third feedback signal to generate a second updated coefficient value, and a second beamforming element coupled to receive the second updated coefficient value and the first signal vector to generate a final symbol decision value as a second adaptive beam, wherein the first feedback signal is the first updated coefficient value.

To further achieve the above-described objects of the present invention in a whole or in parts, there is provided an adaptive beamforming method including the steps of: (a) obtaining a tentative symbol decision value by processing a traffic signal vector, (b) obtaining a final updated coefficient value by performing a least mean square (LMS) algorithm at least once with respect to the tentative symbol decision value and a pilot signal vector on the assumption that the tentative symbol decision value is a transmitted symbol value, and (c) forming an adaptive beam which corresponds to a final symbol decision value using the traffic signal vector and the final updated coefficient value.

Additional advantages, objects, and features of the invention will be set forth in part in the description which follows and in part will become apparent to those having ordinary skill in the art upon examination of the following or may be learned from practice of the invention. The objects and advantages of the invention may be realized and attained as particularly pointed out in the appended claims.

BRIEF DESCRIPTION OF THE DRAWINGS

The invention will be described in detail with reference to the following drawings in which like reference numerals refer to like elements wherein.

DETAILED DESCRIPTION OF PREFERRED EMBODIMENTS

Reference will now be made in detail to the preferred embodiments of the present invention, examples of which are illustrated in the accompanying drawings.

According to the preferred embodiments of the present invention, the dedicated channels (DCHs) of the reverse channels in a communication system, for example a European Telecommunications Standard Institute (ETSI) system, transfer the user information and the control information from the mobile station to the base station.

One of the DCHs, the DPDCH, is a channel for transmitting therethrough the user data, and another DCH, the DPCCH, is a channel for transmitting therethrough the pilot signal, the TPC signal, and the TFI signal. The occupation ratio of the TPC and the TFI signals among these signals is relatively small, and thus it is reasonable to assume that the DPCCH is essentially a pilot channel which obtains accurate data by the decision dedicated (DD) method.

The adaptive beamforming method according to embodiments of the present invention employs the DD-LMS (least mean square) algorithm to use the traffic information and the LMS algorithm to use the pilot information. Embodiments of the present invention are described according to the application of the two kinds of information.

Specifically, the embodiments of the present invention first describe a cascade structure and a parallel structure, and the parallel structure is then divided into a first DD-LMS type and a second DD-LMS type according to the type of tentative decision.

First Embodiment

Figure 1:
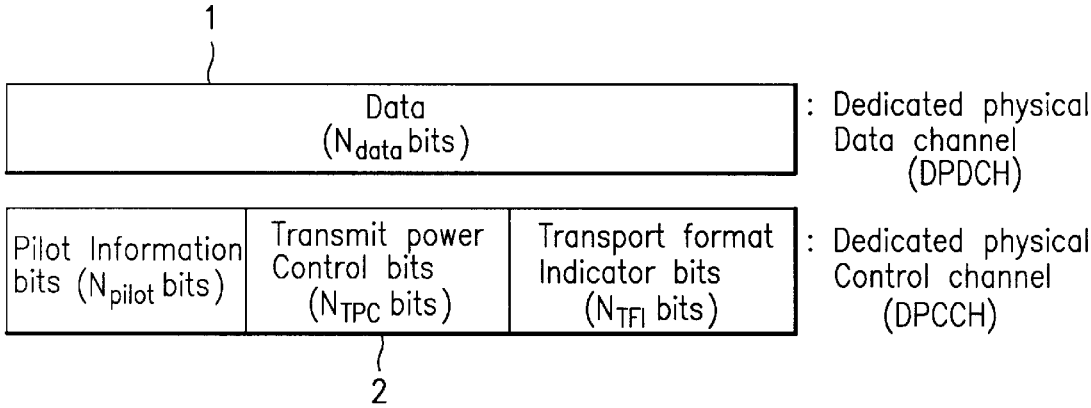
FIG. 1 Prior Art
FIG. 1 is a diagram illustrating the reverse DPDCH and the reverse DPCCH slot structures in a related communication system.
Figure 2:
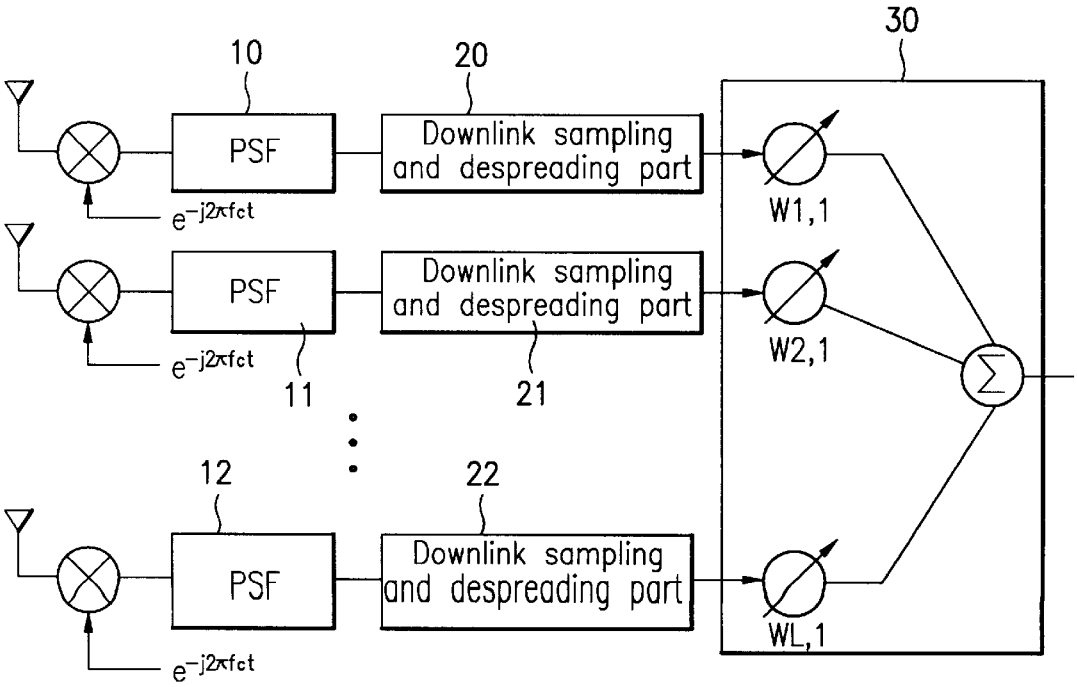
FIG. 2 Prior Art
FIG. 2 is a block diagram illustrating the construction of the conventional beamforming apparatus of an array antenna.
Figure 3:
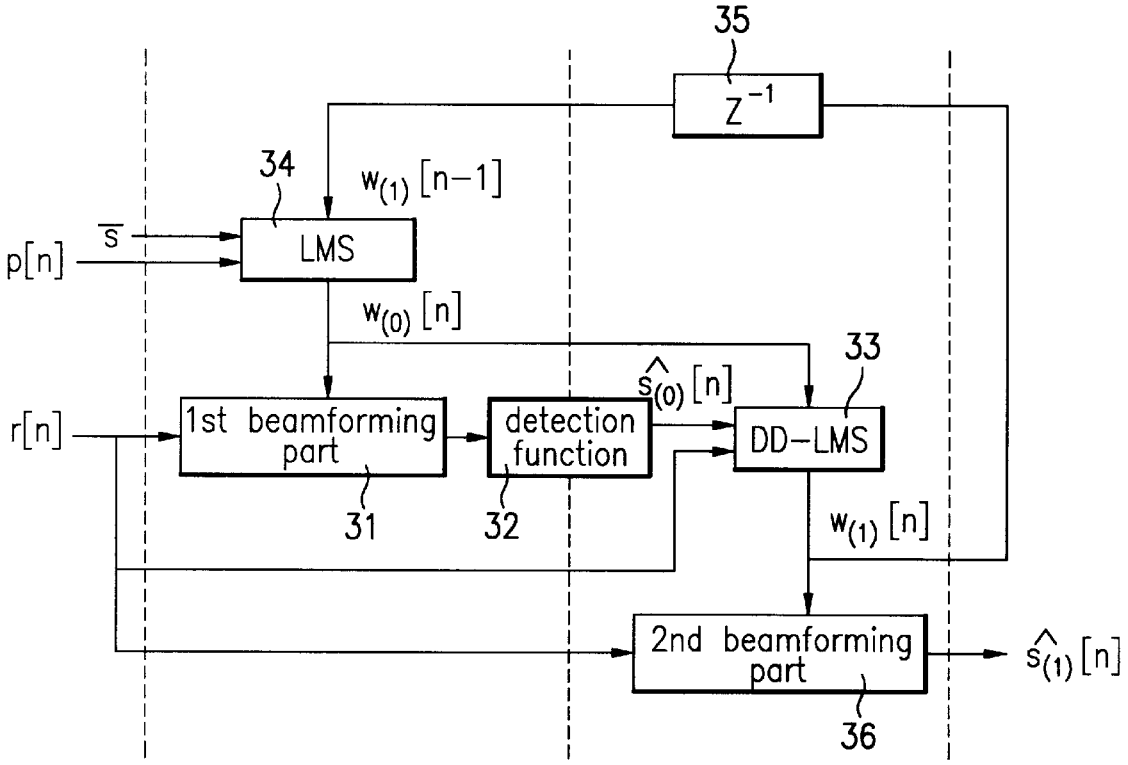
FIG. 3 is a block diagram illustrating the construction of the adaptive beamformer using a dual LMS algorithm according to a first embodiment of the present invention.

FIG. 3 is a block diagram illustrating the construction of the adaptive beamforming apparatus using a dual LMS algorithm according to the first embodiment of the present invention.

Referring to FIG. 3, the adaptive beamforming apparatus according to the first embodiment includes a first beamforming part 31 for forming a first adaptive beam by processing despreading traffic data using a first updated coefficient value as its drive signal. The apparatus further includes a detection function part 32 for obtaining a tentative symbol decision value by processing the first adaptive beam as a detection function, and a decision dedicated least mean square (DD-LMS) part 33 for obtaining a second updated coefficient value by performing an LMS algorithm with respect to the traffic signal vector and the tentative symbol decision value, using the first updated coefficient value as its drive signal.

Additionally, an LMS part 34 obtains the first updated coefficient value by performing the LMS algorithm with respect to a despreading pilot signal vector p[n] and a known vector $\overline{S}$ using a one-step-late (delayed) value of the second updated coefficient value $w_{(1)}[n-1]$. A feedback part 35 provides the one-step-late value of the second updated coefficient value to the LMS part as its drive signal by feeding back the second updated coefficient value. Then, a second beamforming part 36 forms a second adaptive beam corresponding to a final symbol decision value by processing the traffic signal vector using the second updated coefficient value as its drive signal.

In FIG. 3, the pilot signal vector and the traffic signal vector may have either the cascade structure or the parallel structure.

The operation of the adaptive beamforming apparatus of FIG. 3 will now be described. First, the tentative symbol decision value is obtained by processing the traffic signal vector. Then, the final updated coefficient value is obtained by performing the LMS algorithm at least once with respect to the tentative symbol decision value and the pilot signal vector, assuming that the tentative symbol decision value is the transmitted symbol value. Last, the adaptive beam which corresponds to the final symbol decision value is formed using the traffic signal vector and the final updated coefficient value.

Here, if the reliability of the tentative symbol decision value is lower than the threshold value, the tentative symbol decision value is not processed by the LMS algorithm, but is bypassed.

Referring to FIG. 3, an initial updated coefficient value is obtained by performing the LMS algorithm with respect to the pilot signal vector and a known vector in response to a one-step-early value of the final updated coefficient value. Thereafter, the final updated coefficient value is obtained by performing the decision dedicated LMS algorithm with respect to the tentative symbol decision value and the traffic signal vector in response to the initial updated coefficient value.

Meanwhile, an initial adaptive beam is obtained by processing the traffic signal vector in response to the initial updated coefficient value. Then, the tentative symbol decision value is obtained by processing the initial adaptive beam by a detection function.

The first embodiment of the invention will now be described in greater detail.

The coefficient updating according to FIG. 3 can be expressed by the following equation (10).

$$w_{(0)}[n]=w_{(1)}[n-1]+\mu_p\epsilon^*_{LMS}[n]p[n] \qquad \text{Eq. (10)}$$

$$w_{(1)}[n]=w_{(0)}[n-1]+\mu_r\epsilon^*DD[n]r[n]$$

$$\epsilon_{LMS}=\overline{A_1s_1}-w_{(0)}^H[n]p[n]$$

$$\epsilon_{DD}=A_1s_0[n]\hat{s}_0[n]-w_0^H[n]r[n]$$

equation (10), p[n] and r[n] are the n-th pilot signal vector and traffic signal vector, respectively which have passed the corresponding channels and despread, and are defined by the following equation (11).

$$p[n]=[p_1, p_2, \ldots, p_L]^{\tau}, \; r[n]=[r_1, r_2, \ldots, r_L]^{\tau} \qquad \text{Eq. (11)}$$

According to this method, the coefficient $w_0[n]$ of the n-th despreading pilot signal vector p[n] is updated by the LMS part 34 to obtain the first updated coefficient value, and the first updated coefficient value is updated by the DD-LMS part 33 to obtain the second updated coefficient value $w_1[n]$. Thereafter, the second updated coefficient value becomes the final decision value, i.e., an adaptive beam $\hat{s}_{(1)}[n]$ through the second beamforming part 36.

A feedback part 35 feeds the second updated coefficient value back to the LMS part 34. Also, the n-th despreading traffic signal vector r[n] passes through the first beamforming part 31 and the detection function part 32 in turn, thus determining the tentative decision value $\hat{s}_{(0)}[n]$. Equation (12) corresponds to the tentative decision value.

$$\hat{s}_0[n]=\mathrm{dec}(w_0^H[n]r[n]) \quad \text{Eq. (12)}$$

Accordingly, by combining the above two equations (11) and (12) and considering the decision error rate $P_e$, the updated value is given by the following equation (13).

$$w_1[n]=w_1[n-1]+\mu_p\epsilon^*_{DD}[n]r[n](1-2P_e) \quad \text{Eq. (13)}$$

Thus, if respective powers of the signals transmitted through the respective channels are equal and the tentative decision value is correct, the result is that the convergence is guaranteed and the step size $\mu$ is twice extended in effect. However, when an error occurs on the tentative decision value, the sign (i.e., polarity) of the reference signal is reversed, causing the optimum beamforming coefficient not to be found. As this problem affects the probability of the decision error rate $P_e$, misadjustment is increased accordingly. On the other hand, the above structure has the advantages that when the decision error rate $P_e$ is near "0", the coefficient is twice updated in a symbol, and thus the convergence becomes twice as fast in a steady state in comparison to the LMS algorithm.

Second Embodiment

Figure 4:
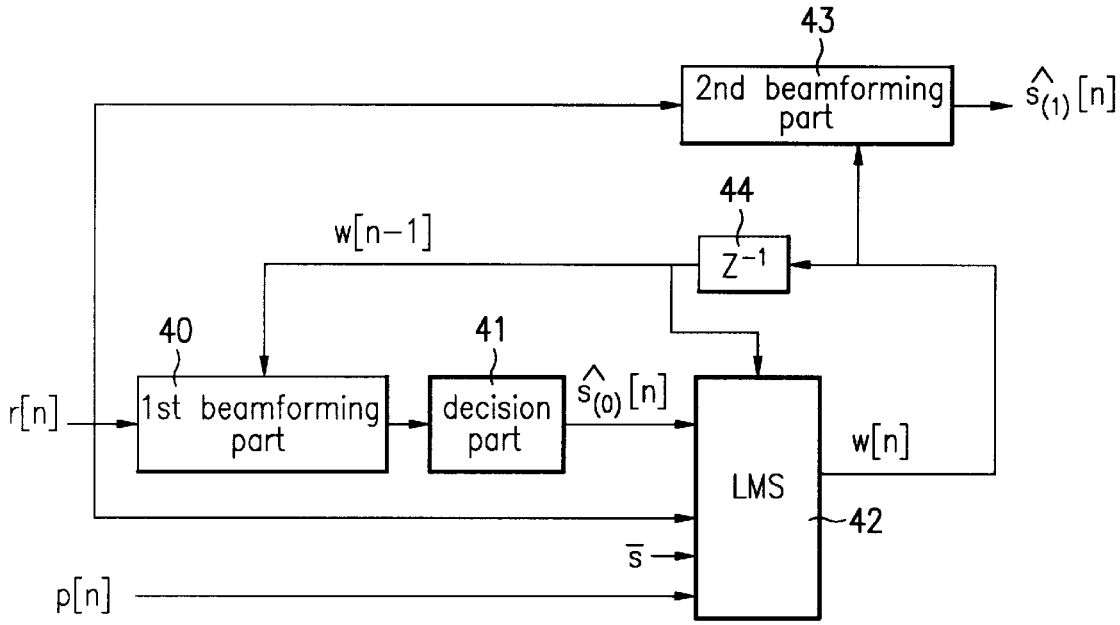
FIG. 4 is a block diagram illustrating the construction of the adaptive beamformer using a decision-oriented LMS algorithm according to a second embodiment of the present invention.

FIG. 4 is a block diagram illustrating the construction of the adaptive beamforming apparatus using a decision-oriented LMS algorithm according to a second embodiment of the present invention.

Referring to FIG. 4, the adaptive beamforming apparatus according to the second embodiment includes a first beamforming part 40 for forming a first adaptive beam by using a despreading traffic signal vector using a one-step-early value of an updated coefficient value as its drive signal. The beamforming apparatus further includes a decision part 41 for obtaining a tentative symbol decision value using the first adaptive beam. Next, a least mean square (LMS) part 42 is included for obtaining the updated coefficient value by performing an LMS algorithm with respect to the tentative symbol decision value, the traffic signal vector, a known vector, and a pilot signal vector using the one-step-early value of the updated coefficient value as its drive signal. Additionally, a second beamforming part 43 obtains a final symbol decision value as an adaptive beam by processing the traffic signal vector using the updated coefficient value as its drive signal, and a feedback part 44 provides a one-step-late value of the updated coefficient value to the first beamforming part and the LMS part by delaying the updated coefficient value by one step.

The operation of the adaptive beamforming apparatus of FIG. 4 is similar to that of the first embodiment of the present invention, and hereinafter, only its operation that differs from that of the first embodiment will be described.

The final updated coefficient value is obtained by processing the LMS algorithm with respect to the pilot signal vector, the tentative symbol decision value, the traffic signal vector, and the known vector in response to the one-step-early value of the final updated coefficient value. The initial adaptive beam is formed by processing the traffic signal vector in response to the one-step-early value of the final updated coefficient value. Then, the tentative symbol decision value is obtained using the initial adaptive beam.

Referring to FIG. 4, the second embodiment of the present invention will be described in fuller detail. The first beamforming part 40 of the adaptive beamforming apparatus receives the n-th despreading traffic signal vector r[n], and performs the beamforming operation using the decision-directed (DD) LMS algorithm.

The decision part 41 obtains the tentative decision value $\hat{s}_{(0)}[n]$ using the output signal of the first beamforming part 40, and outputs the thusly obtained tentative decision value to the LMS part 42.

The LMS part 42 receives the tentative decision value $\hat{s}_{(0)}[n]$, the despreading pilot signal vector p[n], the known signal vector $\bar{s}$ and the n-th despreading traffic signal vector r[n], and outputs the updated coefficient value w[n] by performing the LMS process.

The second beamforming part 43 next receives the updated coefficient value w[n] and the despreading traffic signal vector r[n], and outputs the final updated coefficient value $\hat{s}_{(1)}[n]$ using these values.

As described above, the coefficient updating obtained by the adaptive beamforming method using the DD-LMS algorithm according to the second embodiment of the present invention can be expressed by the following equation (14).

$$w[n]=w[n-1]+\gamma\mu_p\epsilon^*_{LMS}[n]p[n]+(1-\gamma)\mu_r\epsilon^*_{DD}[n]r[n] \quad \text{Eq. (14)}$$

where, $$\epsilon_{LMS}=\overline{A_1 s_1}-w^H[n]p[n]$$

$$\epsilon_{DD}=A_1 s_0[n]\hat{s}_0[n]-w^H[n]r[n]$$

$$0<\gamma<1.$$

The tentative decision value is given by the following equation (15).

$$\hat{s}_0[n]=\mathrm{dec}\{w^H[n-1]r[n]\} \quad \text{Eq. (15)}$$

As described above, the adaptive beamforming method using the DD-LMS algorithm according to the second embodiment of the present invention has the parallel structure, and uses the tentative decision value $\hat{s}_{(0)}[n]$ to determine the final decision value $\hat{s}_{(1)}[n]$.

According to the second embodiment, if the tentative symbol decision value is accurately determined, the strength of the signal used in the LMS algorithm is described.

If the tentative decision value $\hat{s}_{(0)}[n]$ is reversely restored, the reference signal is changed, and thus the coefficient estimation may be performed in a different direction. However, the degree thereof can be adjusted according to the error probability of $\gamma$ and the tentative decision value.

Third Embodiment

Figure 5:
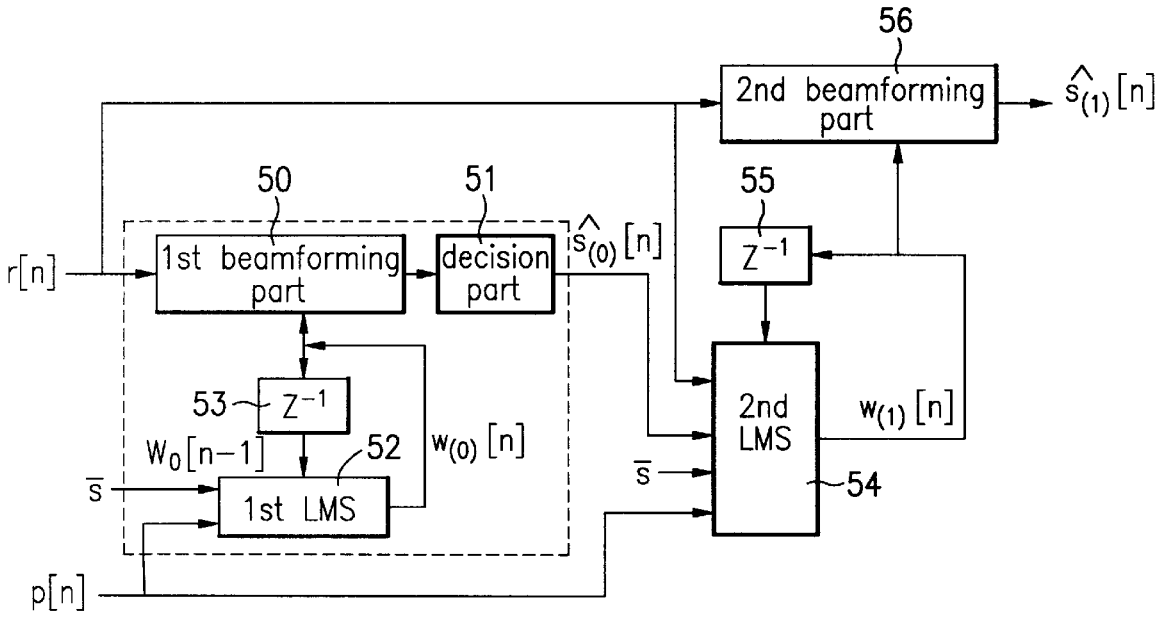
FIG. 5 is block diagram illustrating the construction of the adaptive beamformer using a decision-oriented LMS algorithm according to a third embodiment of the present invention.

FIG. 5 is block diagram illustrating the construction of the adaptive beamforming apparatus using the decision-oriented LMS algorithm according to the third embodiment of the present invention.

Referring to FIG. 5, the adaptive beamforming apparatus according to the third embodiment of the present invention includes a first beamforming part 50 for forming a first adaptive beam by using a despreading traffic signal vector using a first updated coefficient value as its drive signal. The adaptive beamforming apparatus further includes a decision part 51 for obtaining a tentative symbol decision value by processing the first adaptive beam. Next, a first LMS part 52 is included for obtaining the first updated coefficient value by performing an LMS algorithm with respect to the pilot signal vector and a known vector using a one-step-late value of the first updated coefficient value as its drive signal. Additionally, a first feedback part 53 provides the one-step-late value of a second updated coefficient value to the first LMS part by feeding back the first updated coefficient value.

The adaptive beamforming apparatus further includes a second LMS part 54 for obtaining a second updated coefficient value by performing the LMS algorithm with respect to the despreading traffic signal vector, the tentative symbol decision value, the known vector, and the despreading pilot signal vector using a one-step-late value of the second updated coefficient value as its drive signal. A second beamforming part 56 obtains a final symbol decision value as a second adaptive beam using the second updated coefficient value and the traffic signal vector, and a second feedback part 55 provides the one-step-late value of the second updated coefficient value to the second LMS part 54 as its drive signal by feeding back the second updated coefficient value.

The operation of the adaptive beamforming apparatus of the third embodiment is similar to that of the first embodiment of the present invention, and hereinafter, only the features specific to the third embodiment will be explained.

The initial updated coefficient value is obtained by performing the LMS algorithm with respect to the pilot signal vector and the known vector in response to the one-step-early value of the initial updated coefficient value. Then, the final updated coefficient value is obtained by performing the LMS algorithm with respect to the tentative symbol decision value, the traffic signal vector, the known vector, and the pilot signal vector in response to the one-step-early value w1[n−1] of the final updated coefficient value w1[n]. Thereafter, the tentative symbol decision value is obtained by processing the initial beam.

Referring to FIG. 5, the third embodiment of the present invention will be described. The first beamforming part 50 of the adaptive beamforming apparatus using the DD-LMS algorithm performs the beam forming operation using the n-th despreading traffic signal vector r[n]. Additionally, the decision part 51 obtains the tentative decision value $\hat{s}_{(0)}[n]$ using the output signal of the first beamforming part 50, and outputs the obtained tentative decision value to the second LMS part 54.

Meanwhile, the first LMS part 52 receives the known signal vector s-bar and the n-th despreading pilot signal vector p[n], and outputs the first updated coefficient value $w_{(0)}[n]$ by performing the LMS process using the received values.

The second LMS part 54 outputs the second updated coefficient value $w_{(1)}[n]$ to the second beamforming part 56 by performing the LMS process using the despreading traffic signal vector r[n], the tentative decision value $\hat{s}_{(0)}[n]$, the n-th despreading pilot signal vector p[n], and the known signal vector $\overline{S}$.

The second beamforming part 56 outputs the final updated coefficient value $\hat{s}_{(1)}[n]$ using the second updated coefficient value $w_{(1)}[n]$ and the despreading traffic signal vector r[n]. The final updated coefficient value corresponds to the adaptive beam.

As described above, the coefficient updating obtained by the adaptive beamforming method using the DD-LMS algorithm according to the third embodiment of the present invention can be expressed by the following equation (16).

$$w[n]=w[n-1]+\gamma\mu_p\epsilon^*_{LMS}[n]p[n]+(1-\gamma)\mu_r\epsilon^*_{DD}[n]r[n] \qquad \text{Eq. (16)}$$

According to equation (16), the third embodiment is identical to the second embodiment, and has the parallel structure which is the same as that of the second embodiment.

Here, $$\epsilon_{LMS}=\overline{A_1s_1}-w_{(0)}^H[n]p[n]$$

$$\epsilon_{DD}=A1s0[n]\hat{s}[n]-w^H[n]r[n]$$

In the above equations, $\epsilon_{LMS}$ is different from the second embodiment, and the tentative decision value $\hat{s}_{(0)}[n]$ can be given by the following equation (17).

$$\hat{s}_0[n]=\mathrm{dec}\{w_{(0)}^H[n]r[n]\} \qquad \text{Eq. (17)}$$

As shown in the above equations, in order to increase the reliability of the tentative decision value $\hat{s}_{(0)}[n]$, the coefficient used in the restoration of the tentative decision value is determined only by the pilot information, which has a high reliability.

Accordingly, the tentative decision error becomes $P'_e$. Thus, the strength of the signal used for obtaining $w_{(0)}^H[n]$ in a separate LMS is reduced in comparison to the method as shown in FIG. 4. In this case, it is determined that $P'_e>P_e$, the reliability of the tentative decision value may be rather reduced. However, if the reliability of the final decision value is sufficiently guaranteed, it matters little.

As described above, the present invention has the following effects.

First, the interference signal due to the receiving angle during the beamforming operation in the communication system, which has adaptive antennas using several reverse antennas, can be removed and antenna diversity can be obtained. Thus, the power load of the mobile station can be reduced.

Second, the capacity of the communication system can be reduced and the transmission ratio can be increased.

The present invention has been described based on the ETSI system, but can be widely applied to the next-generation mobile communication system or any similar communication system.

The foregoing embodiments and advantages are merely exemplary and are not to be construed as limiting the present invention. The present teaching can be readily applied to other types of apparatuses. The description of the present invention is intended to be illustrative, and not to limit the scope of the claims. Many alternatives, modifications, and variations will be apparent to those skilled in the art. In the claims, means-plus-function clauses are intended to cover the structures described herein as performing the recited function and not only structural equivalents but also equivalent structures.

What is claimed is:

1. An adaptive beamforming apparatus of an array antenna, comprising:

a first beamforming element, coupled to receive a traffic signal vector and a driver signal, to form a first adaptive beam;

a detection function element, coupled to receive the first adaptive beam and to form a tentative symbol decision value;

a first least mean square (LMS) element, coupled to receive a pilot signal vector, a known vector, and a feedback signal to generate a first updated coefficient value;

a second LMS element, coupled to receive the traffic signal vector, the tentative symbol decision value, and the first updated coefficient value to form a second updated coefficient value; and a second beamforming element, coupled to receive the traffic signal vector and the second updated coefficient value to form a second adaptive beam.

2. The apparatus of claim 1, wherein the traffic signal vector and the pilot signal vector have one of a cascade structure and a parallel structure.

3. The apparatus of claim 1, further comprising a feedback element coupled to receive the second updated coefficient value and output a delayed value of the second updated coefficient value, wherein the feedback signal is the delayed value of the second updated coefficient value.

4. The apparatus of claim 1, wherein the second LMS element comprises a decision-dedicated LMS element.

5. The apparatus of claim 1, wherein the first beamforming element processes the traffic signal vector using the first updated coefficient value as its drive signal, wherein the first LMS element performs an LMS algorithm with respect to the pilot signal vector and the known vector using the delayed value of the second updated coefficient value as its drive signal, and wherein the second LMS element performs an LMS algorithm with respect to the traffic signal vector and the tentative symbol decision value, using the first updated coefficient value as its drive signal.

6. An adaptive beamforming apparatus of an array antenna, comprising:

a first beamforming element coupled to receive a traffic signal vector and a driver signal to form a first adaptive beam;

a decision element coupled to receive the first adaptive beam and output a tentative symbol decision value;

a least mean square (LMS) element coupled to receive the traffic signal vector, the tentative symbol decision value, a known vector, a pilot signal vector, and the driver signal to form an updated coefficient value; and a second beamforming element coupled to receive the traffic signal vector and the updated coefficient value to generate a final symbol decision value as an adaptive beam.

7. The apparatus of claim 6, wherein the traffic signal vector and the pilot signal vector have one of a cascade structure and a parallel structure.

8. The apparatus of claim 6, wherein the driver signal comprises a delayed value of the updated coefficient value that is fed back from the LMS element.

9. The apparatus of claim 6, wherein the LMS element performs a LMS algorithm with respect to the tentative symbol decision value, the traffic signal vector, the known vector, and the pilot signal vector using the feedback signal as its drive signal.

10. The apparatus of claim 6, further comprising a feedback element coupled to receive the updated coefficient value and output the feedback signal.

11. The apparatus of claim 10, wherein the feedback element outputs a delayed value of the updated coefficient value as the feedback signal.

12. An adaptive beamforming apparatus of an array antenna, comprising:

a first beamforming element coupled to receive a first signal vector and a driver signal, to form a first adaptive beam;

a first least mean square (LMS) element coupled to receive a second signal vector, a known vector, and a first feedback signal to generate a first updated coefficient value;

a decision element coupled to receive the first adaptive beam and to form a tentative symbol decision value;

a second LMS element, coupled to receive the first signal vector, the tentative symbol decision value, the known vector, the second signal vector and a second feedback signal to generate a second updated coefficient value; and a second beamforming element coupled to receive the second updated coefficient value and the first signal vector to generate a final symbol decision value as a second adaptive beam, wherein the driver signal is the first updated coefficient value.

13. The apparatus of claim 12, wherein the first signal vector and the second signal vector have one of a cascade structure and a parallel structure.

14. The apparatus of claim 12, wherein the first feedback signal is a delayed value of the first updated coefficient value, and the second feedback signal is a delayed value of the second updated coefficient value.

15. The apparatus of claim 12, wherein the first LMS element performs a LMS algorithm with respect to the second signal vector and the known vector using the first feedback signal as its drive signal, and wherein the second LMS element performs a LMS algorithm with respect to the first signal vector, the tentative simple decision value, the known value, and the second signal vector, using the second feedback signal as its drive signal.

16. The apparatus of claim 12, further comprising a first feedback element coupled to receive the first updated coefficient value and generate the first feedback signal, and a second feedback element coupled to receive the second updated coefficient value and output the second feedback signal.

17. The apparatus of claim 16, wherein the first feedback signal is a delayed value of the first updated coefficient value and the second feedback signal is a delayed value of the second updated coefficient value.

18. An adaptive beamforming method, comprising:

(a) obtaining a tentative symbol decision value by processing a traffic signal vector;

(b) obtaining a final updated coefficient value by performing a least mean square (LMS) algorithm at least once with respect to the tentative symbol decision value and a pilot signal vector on the assumption that the tentative symbol decision value is a transmitted symbol value; and (c) forming an adaptive beam which corresponds to a final symbol decision value using the traffic signal vector and the final updated coefficient value.

19. The method of claim 18, further comprising the step of bypassing the tentative symbol decision value without processing the tentative symbol decision value by the LMS algorithm if a reliability of the tentative symbol decision value is lower than a threshold value.

20. The method of claim 18, wherein the step (b) comprises:

(b-1) obtaining an initial updated coefficient value by performing the LMS algorithm with respect to the pilot signal vector and a known vector in response to a delayed value of the final updated coefficient value; and (b-2) obtaining the final updated coefficient value by performing a decision-dedicated LMS algorithm with respect to the tentative symbol decision value and the traffic signal vector in response to the initial updated coefficient value.

21. The method of claim 20, wherein the step (a) comprises:

(a-1) obtaining an initial adaptive beam by processing the traffic signal vector in response to an initial updated coefficient value; and (a-2) obtaining the tentative symbol decision value by processing the initial adaptive beam by a detection function.

22. The method of claim 18, wherein the pilot signal vector and the traffic signal vector have one of a cascade structure and a parallel structure.

23. The method of claim 18, wherein the step (b) comprises:

(b-1) obtaining the final updated coefficient value by processing the LMS algorithm with respect to the pilot signal vector, the tentative symbol decision value, the traffic signal vector, and a known vector in response to a delayed value of the final updated coefficient value.

24. The method of claim 23, wherein the step (a) comprises:

(a-1) forming an initial adaptive beam by processing the traffic signal vector in response to a delayed value of the final updated coefficient value; and (a-2) obtaining the tentative symbol decision value using the initial adaptive beam.

25. The method of claim 18, wherein the step (b) comprises:

(b-1) obtaining an initial updated coefficient value by performing the LMS algorithm with respect to the pilot signal vector and a known vector in response to a delayed value of the initial updated coefficient value; and (b-2) obtaining the final updated coefficient value by performing the LMS algorithm with respect to the tentative symbol decision value, the traffic signal vector, the known vector, and the pilot signal vector in response to the delayed value of the final updated coefficient value.

26. The method of claim 25, wherein the step (a) comprises:

(a-1) forming an initial beam by processing the traffic signal vector in response to an initial updated coefficient value; and (a-2) obtaining the tentative symbol decision value by processing the initial beam.

27. The apparatus of claim 6, wherein the first beamforming part forms the first adaptive beam using a decision directed least mean square algorithm.

28. The apparatus of claim 12, wherein the first signal vector is a despreading traffic signal vector and the second signal vector is a pilot signal vector.

29. An adaptive beam-forming apparatus in a CDMA mobile communication system having a data channel and a control channel, comprising:

a first coefficient calculator configured to calculate a first adaptive beam coefficient based on a control signal received through the control channel;

a first beam generator configured to generate a first adapted data signal based on an original data signal received through said data channel and the first adaptive beam coefficient;

a tentative signal determination device configured to determine a tentative decision value based on the first adapted data signal;

a second coefficient calculator configured to calculate a second adaptive beam coefficient based on said original data signal and said tentative decision value; and a second beam generator configured to generate a second adapted data signal based on the original data signal and the second adaptive beam coefficient.

30. The apparatus of claim 29, wherein the first and second coefficient calculators use a least mean square method to calculate the first and second adaptive beam coefficients.

31. An apparatus in a CDMA mobile communication system having a data channel and a control channel, comprising:

a first coefficient calculator configured to calculate a n-th first adaptive beam coefficient based on a control signal received through the control channel and a (n−1)th second adaptive beam coefficient;

a first beam generator configured to generate a first adapted data signal based on an original data signal received through the data channel and the n-th adaptive beam coefficient;

a tentative signal determiner configured to determine a tentative decision value based on the first adapted data signal;

a second coefficient calculator configured to calculate a n-th second adaptive beam coefficient based on the original data signal, the tentative decision value, and the n-th first adaptive beam coefficient; and a second beam generator configured to generate a second adapted data signal based on the original data signal and the n-th second adaptive beam coefficient.

32. The apparatus of claim 31, wherein said first and second coefficient calculators use a least mean square method to calculate the n-th first adaptive beam coefficient and the n-th second adaptive beam coefficient.

33. An apparatus in a CDMA mobile communication system having a data channel and a control channel, comprising:

a first beam generator configured to generate a first adapted data signal based on an original data signal received through said data channel and an (n−1)th adaptive beam coefficient;

a tentative signal determiner configured to determine a tentative decision value based on said first adapted data signal;

a coefficient calculator configured to calculate a n-th adaptive beam coefficient based on said original data signal, said tentative decision value, a control signal received through said control channel, and said (n−1)th adaptive beam coefficient; and a second beam generator configured to generate a second adapted data signal based on said original data signal and said n-th adaptive beam coefficient.

34. The apparatus of claim 33, wherein said coefficient calculator calculates said n-th adaptive beam coefficient by comparing said control signal with a known signal.

35. The apparatus of claim 33, wherein said coefficient calculator uses a least mean square method to calculate said n-th adaptive beam coefficient.

36. An apparatus in a CDMA mobile communication system having a data channel and a control channel, comprising:

a first coefficient calculator configured to calculate a n-th first adaptive beam coefficient based on a control signal received through said control channel and an (n−1)th first adaptive beam coefficient;

a first beam generator configured to generate a first adapted data signal based on an original data signal received through said data channel and said n-th first adaptive beam coefficient;

a tentative signal determiner configured to determine a tentative decision value based on said first adapted data signal;

a second coefficient calculator configured to calculate a n-th second adaptive beam coefficient based on said original data signal, said tentative decision value, said control signal, and an (n−1)th second adaptive beam coefficient; and a second beam generator configured to generate a second adapted data signal based on said original data signal and said n-th second adaptive beam coefficient.

37. The apparatus of claim 36, wherein said first and second coefficient calculators use a least mean square method to calculate said n-th first adaptive beam coefficient and said n-th second adaptive beam coefficient.

38. A method of adaptive beamforming in a CDMA mobile communication system having a data channel and a control channel, comprising:

calculating a first adaptive beam coefficient based on a control signal received through said control channel;

generating a first adapted data signal based on an original data signal received through said data channel and said first adaptive beam coefficient;

determining a tentative decision value based on said first adapted data signal;

calculating a second adaptive beam coefficient based on said original data signal and said tentative decision value; and generating a second adapted data signal based on said original data signal and said second adaptive beam coefficient.

39. The method of claim 38, wherein said control signal is a pilot signal.

40. The method of claim 39, wherein said first adaptive beam coefficient is calculated by comparing a first symbol of said pilot signal with a second symbol of another known pilot signal.

41. The method of claim 38, wherein said second adaptive beam coefficient is calculated by comparing a first symbol of said original data signal with a second symbol of said tentative decision value.

42. The method of claim 38, wherein said first adaptive beam coefficient and said second adaptive beam coefficient are calculated using a least mean square method.

43. A method of adaptive beamforming in a CDMA mobile communication system having a data channel and a control channel, comprising:

calculating a n-th first adaptive beam coefficient based on a control signal received through said control channel and a (n−1)th second adaptive beam coefficient;

generating a first adapted data signal based on an original data signal received through said data channel and said n-th first adaptive beam coefficient;

determining a tentative decision value based on said first adapted data signal;

calculating a n-th second adaptive beam coefficient based on said original data signal, said tentative decision value, and said n-th first adaptive beam coefficient; and generating a second adapted data signal based on said original data signal and said n-th second adaptive beam coefficient.

44. The method of claim 43, wherein said n-th first adaptive beam coefficient and said n-th second adaptive beam coefficient are calculated during a same symbol period.

45. A method of adaptive beamforming in a CDMA mobile communication system having a data channel and a control channel, comprising:

generating a first adapted data signal based on an original data signal received through said data channel and an (n−1)th adaptive beam coefficient;

determining a tentative decision value based on said first adapted data signal;

calculating a n-th adaptive beam coefficient based on said original data signal, said tentative decision value, a control signal received through said control channel, and said (n−1)th adaptive beam coefficient; and generating a second adapted data signal based on said original data signal and said n-th adaptive beam coefficient.

46. The method of claim 45, wherein said n-th adaptive beam coefficient is calculated by comparing said control signal with a known signal.

47. A method of adaptive beamforming in a CDMA mobile communication system having a data channel and a control channel, comprising:

calculating a n-th first adaptive beam coefficient based on a control signal received through said control channel and an (n−1)th first adaptive beam coefficient;

generating a first adapted data signal based on an original data signal received through said data channel and said n-th first adaptive beam coefficient;

determining a tentative decision value based on said first adapted data signal;

calculating a n-th second adaptive beam coefficient based on said original data signal, said tentative decision value, said control signal, and a (n−1)th second adaptive beam coefficient; and generating a second adapted data signal based on said original data signal and said n-th second adaptive beam coefficient.

48. The method of claim 47, wherein said n-th first adaptive beam coefficient and said n-th second adaptive beam coefficient are calculated during a same symbol period.

49. The apparatus of claim 1, wherein the second adaptive beam is a final decision variable.

50. The apparatus of claim 1, wherein the driver signal comprises the first updated coefficient value.

* * * * *